US009463549B2

(12) United States Patent
Schmidt et al.

(10) Patent No.: US 9,463,549 B2
(45) Date of Patent: Oct. 11, 2016

(54) METHOD OF GAP SETTING SLIDE GRINDING MACHINE

(71) Applicant: Roesler Holding GmbH & Co. KG, Bad Staffelstein (DE)

(72) Inventors: Egon Schmidt, Poppenhausen (DE); Ralf Mueller, Grossheirath (DE); Erwin Denninger, Maroldsweisach (DE); Dennis Eichenberg, Marktzeuln (DE)

(73) Assignee: ROESLER HOLDING GMBH & CO. KG, Bad Staffelstein (DE)

( * ) Notice: Subject to any disclaimer, the term of this patent is extended or adjusted under 35 U.S.C. 154(b) by 212 days.

(21) Appl. No.: 14/219,256

(22) Filed: Mar. 19, 2014

(65) Prior Publication Data

US 2014/0287655 A1 Sep. 25, 2014

(30) Foreign Application Priority Data

Mar. 19, 2013 (DE) ..... 10 2013 204 816

(51) Int. Cl.
*B24B 31/12* (2006.01)
*B24B 31/108* (2006.01)
*B24B 31/02* (2006.01)

(52) U.S. Cl.
CPC ..... *B24B 31/12* (2013.01); *B24B 31/02* (2013.01); *B24B 31/108* (2013.01)

(58) Field of Classification Search
CPC ..... B24B 31/02; B24B 31/108; B24B 31/12
See application file for complete search history.

(56) References Cited

U.S. PATENT DOCUMENTS 4,939,871 A * 7/1990 Ditscherlein ..... B24B 31/108 451/1
5,295,330 A * 3/1994 Hoffman ..... B24B 31/108 384/100
5,476,415 A * 12/1995 Nishimura ..... B24B 31/12 451/326
5,823,861 A * 10/1998 Kobayashi ..... B24B 31/12 451/104
6,213,854 B1 * 4/2001 Gegenheimer ..... B24B 31/108 451/326
6,296,556 B1 * 10/2001 Gegenheimer ..... B24B 31/108 451/326
6,656,027 B2 * 12/2003 Dietrich ..... B24B 31/108 451/326
6,682,401 B2 * 1/2004 Kobayashi ..... B24B 31/108 451/28
8,801,498 B2 * 8/2014 Hammond ..... B24B 31/108 451/104

FOREIGN PATENT DOCUMENTS

DE 3802542 C1 8/1989
DE 4311689 A1 10/1994
DE 4311690 A1 10/1994
DE 4324132 A1 1/1995

* cited by examiner

*Primary Examiner* — Timothy V Eley
(74) *Attorney, Agent, or Firm* — Leech Tishman Fuscaldo & Lampl; Kenneth D'Alessandro, Esq.

(57) ABSTRACT

In a method for the automatic gap setting in slide grinding machines having a turntable, the gap width between the turntable and the work container is automatically set by a regulation, with a reference value for the gap width of zero being determined.

13 Claims, 2 Drawing Sheets

METHOD OF GAP SETTING SLIDE GRINDING MACHINE

Figure 1:
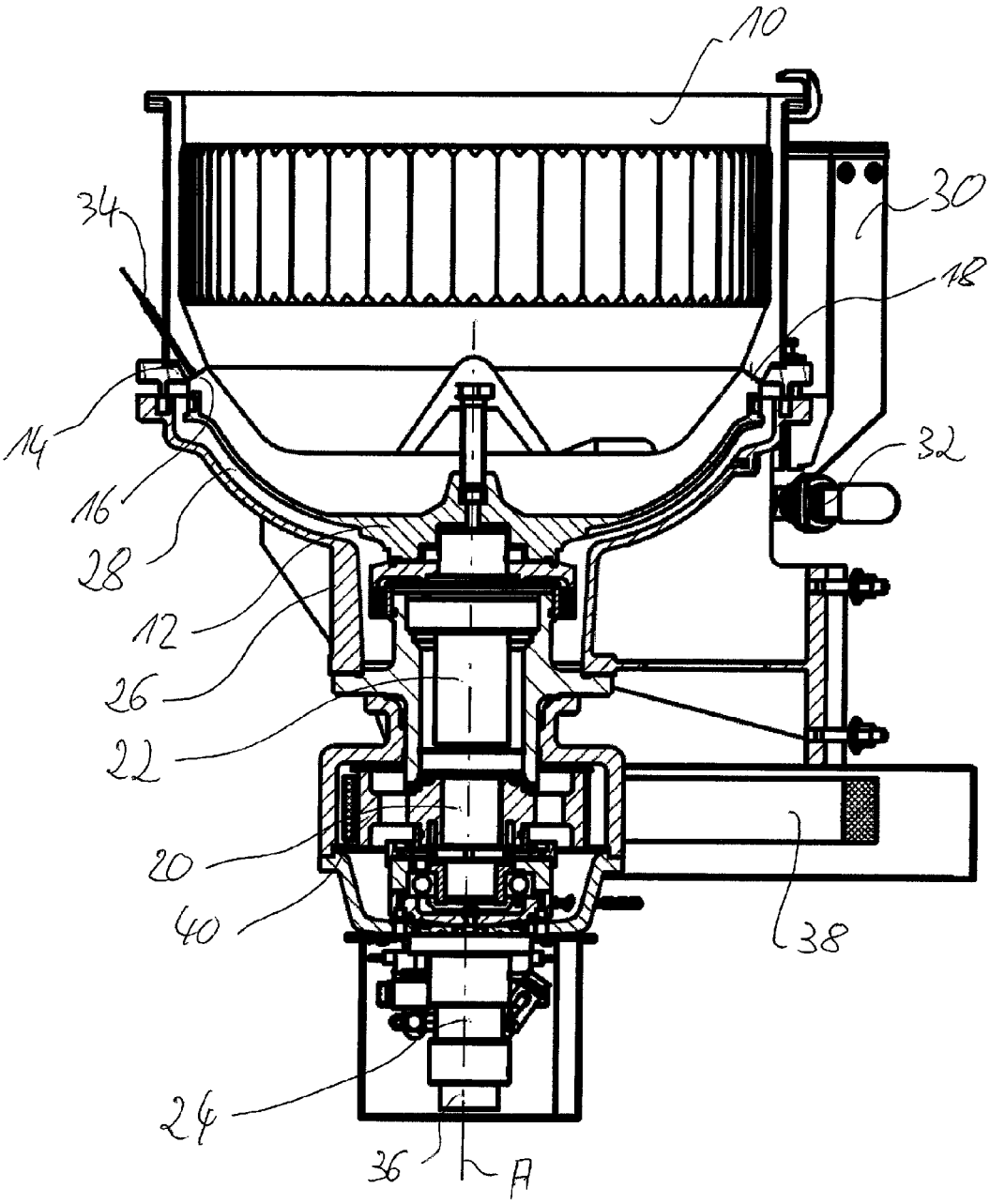

The present invention relates to a method for an automatic gap setting in slide grinding machines having a turntable, wherein the gap width of a gap located between the turntable and a work container is set by a regulation.

In slide grinding machines having a turntable, a work container is charged with workpieces and optionally also with abrasives which are set into rotational movement by the rotating turntable, wherein water and cleaning agents are conducted through the container. An annular gap, which can be in the range of, for example, approximately 0.2 mm to 0.8 mm, is present between the turntable and the fixed-position work container.

Since changes in the gap width can influence the liquid throughflow, on the one hand, and can cause a jamming of workpieces or abrasives, on the other hand, it is desirable to maintain a preset desired gap width during operation. It is already known from the prior art for this purpose to set the gap width in an automated fashion by a regulation. It has, however, been found in practice that such an automated gap width setting does not work satisfactorily in the long term.

Different methods for an automatic gap setting in slide grinding machines having a turntable are known from DE 38 02 542 C1. In one of these methods, gaseous medium is, for example, introduced into the gap between the turntable and the work container at one pone and the dynamic head arising in the medium in the infeed serves as a regulation parameter for an automatic setting of the gap width. In accordance with another regulation process known from this document, the gap width can be measured indirectly via the temperature in the region of the gap. Both methods have not proved practical in the past.

It is therefore the object of the present invention to provide a method of the above kind and to provide a corresponding apparatus with which method and apparatus a permanently satisfactory gap width regulation can be achieved.

This object is satisfied by the features of the independent claims.

In the method in accordance with the invention, the gap is first acted on by compressed air in a first step for determining a gap width so that the air pressure arising in the gap can be measured on the pressure side. The pressure side is in this respect understood as that side of the gap which is acted on by compressed air. In this respect, the supply of the compressed air does not only open directly into the gap at one point. The ring gap is rather acted on by compressed air from one side along its total periphery.

After being acted on by compressed air, the turntable and the work container can be moved toward one another in relation to one another so that the gap also increasingly closes. The measured air pressure hereby increases on the pressure side. With an increasing approach of the turntable to the container (or vice versa), the gap closes increasingly until the measured air pressure has reaches a predefined limit value at no air or almost no air can pass through the gap any longer. At this point in time, that relative position of the turntable and the work container can then be defined as the reference value for the gap width of zero which is present at this point in time. In other words, that relative position of the turntable and the work container is defined as the reference value for the gap width of zero which is present when the measured air pressure has reached a predefined limit value, for example a value of 150 mbar. It is hereby ensured that the two components admittedly tightly contact one another, but that they are not pressed excessively hard onto one another and, for example, deform in the region of a coating. In a second step, on the basis of this defined relative positions, i.e. of the determined spacing between the turntable and the work container on reaching the predefined limit value, the desired gap width, i.e. the desired axial spacing between the work container and the turntable, can then be regulated such that it remains constant in this region. The regulation preferably takes place without any further measurement of the compressed air on the pressure side, namely only via a temperature regulation by measuring the temperature in the gap region.

An automated gap width regulation can be carried out extremely reliably and permanently using the method in accordance with the invention since the zero position required for this gap width regulation is determined extremely precisely without the work container and/or the turntable being damaged in so doing. These two components are usually coated with hot cast polyurethane in practice which could be permanently damaged on too great an engagement of the turntable at the container. However, with the method in accordance with the invention, the turntable can be engaged comparatively gently and only for so long until the predefined limit value of the compressed air is reached which defines the gap width of zero and the corresponding relative position of the turntable and the work container.

Furthermore, using the method in accordance with the invention, a wear of the turntable and and/or the work container can be compensated since a desired gap width can also be exactly regulated by a repeat detection and definition of the zero position if the gap surfaces should have changed due to wear.

using the two-step method in accordance with the invention, first only the gap width of zero is defined with the aid of the air pressure measurement in a first step at which the turntable and the work container admittedly tightly contact one another, but are not pressed too hard against one another. Starting from this zero position, a desired gap width is then set in a second step without an air pressure measurement. The regulation of the gap width preferably takes place via a temperature regulation at which the gap is increased or decreased in dependence on a temperature measured in the gap region. The change in the gap region, however, always takes place in relation to the originally determined zero position which was determined with the aid of the air pressure measurement carried out via the periphery of the ring gap.

Advantageous embodiments of the invention are described in the description, in the drawing and in the dependent claims.

In accordance with an advantageous embodiment, a new reference value for the gap width of zero can be defined after a predefined operating period of the slide grinding machine has been reached and/or after a predefined temperature change has been reached in the region of the gap. Such a temperature change can be caused, on the one hand, by a change of the room temperature, but also by a temperature change of the work container and of the turntable during operation which is e.g. caused by process liquid of different temperatures. It may therefore be advantageous if the constant gap width is regulated only while taking account of a temperature measured in the region of the gap. Since both the material of the container and of the turntable and the polyurethane coating expand at an increasing temperature, the gap width would vary in operation without a regulation while taking account of the temperature. If, however, the temperature is detected in the region of the gap, a temperature compensation can take place such that the gap width is adjusted accordingly on a change of the temperature by a specific value.

In accordance with a further advantageous embodiment, the relative position between the turntable and the work container can be determined by a displacement sensor. A reproducible and repeatable position detection is hereby possible with an automated regulation.

In accordance with a further advantageous embodiment, the turntable can be moved by a hydraulic cylinder in the direction of the work container and also away from the work container. It can be advantageous in this respect to use a dual-action hydraulic cylinder since then both the approach movement of the turntable to the work container and the return movement of the turntable for setting the desired gap width can be controlled precisely.

In accordance with a further advantageous embodiment, the turntable is set into rotation by a belt drive. In this manner, the whole drive motor does not have to be moved so that the total weight of the moved unit is reduced and the construction is simplified. Furthermore, by use of a belt drive, axial stroke, i.e. the stroke of the turntable in the direction of the work container can be compensated by the belt so that the motor can be mounted in a fixed position on the machine frame and the axial stroke of the driven turntable is compensated by the belt.

In accordance with a further advantageous embodiment, a transducer can be used for measuring the measurement of the air pressure which is used as a liquid level sensor in an operation of the slide grinding machine. On the use of a transducer which can detect pressures in liquid media and also in gaseous media, one and the same sensor can thus be used for the measurement of the air pressure in the region of the gap, on the one hand, and as a measurement sensor for filling levels, on the other hand.

It can be advantageous if, after an operating interruption of a predefined duration, a reference value for a gap value of zero is first automatically again determined before a repeat putting into operation.

In accordance with a further advantageous embodiment, the turntable and the work container are no longer moved toward one another in relation to one another when the measured air pressure has reached a predefined maximum value which is in particular equal to the predefined limit value. It is ensured in this manner that when the zero position is reached, the turntable is no unnecessarily pressed toward the work container so that damage to these components is precluded.

For this purpose, the engagement force of the actuating drive can also be redundantly monitored to prevent damage to the turntable and/or the work container on a failure of the air pressure sensor.

In accordance with a further aspect of the invention, it relates to a slide grinding machine with a work container and a turntable, in particular for carrying out a method of the above-described kind, wherein the gap width of a gap located between the turntable and the work container is set automatically. The slide grinding machine comprises an air pressure device with which the gap can be acted on by compressed air only for determining a gap width of zero. To detect the air pressure arising in the region of the gap on the pressure side, a pressure sensor is provided and an actuating drive serves to move the turntable and the work container toward one another and away from one another in relation to one another. To set a constant predefined gap width, a control and regulation device is provided in which that relative position of the turntable and the work container can be stored as a reference value for a gap width of zero which is present when the air pressure measured in the region of the gap on the pressure side has reached a predefined limit value. Finally, a regulation is implemented in the control and regulation device with which a desired constant gap width can be regulated during the operation of the slide grinding machine with the aid of the actuating drive on the basis of the stored relative position, for example by a temperature regulation without using the air pressure sensor.

A particularly precise and reproducible distance measurement can be achieved in that a distance measurement sensor is integrated into the actuating drive which moves the turntable and the work container relative to one another.

Figure 2:
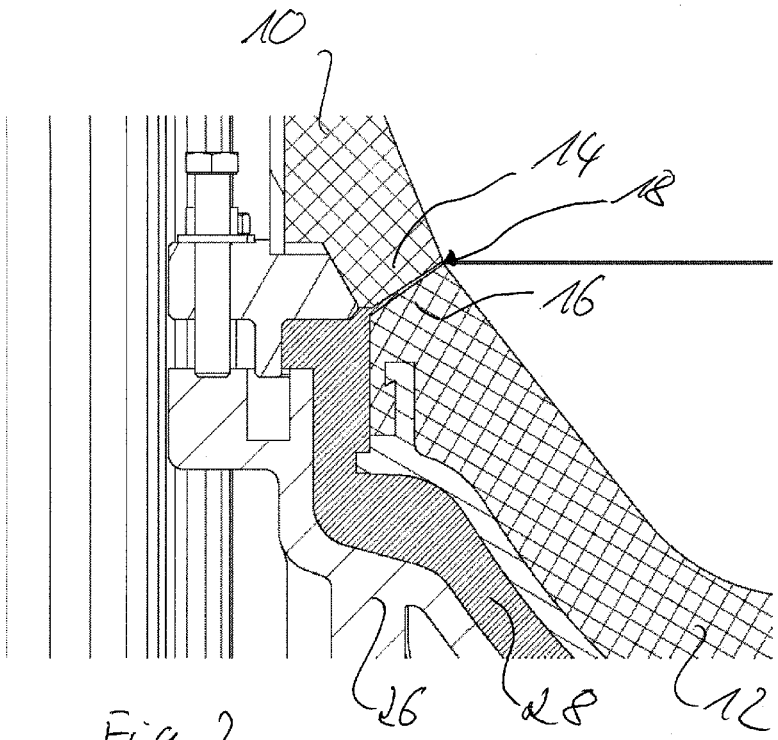

The present invention will be described in the following purely by way of example with reference to an advantageous embodiment and to the enclosed drawings. There are shown:

FIG. 1 a part sectional view of a slide grinding machine in a plane which runs through the axis of rotation of the turntable;

FIG. 2 an enlarged part sectional view of the gap region; and

Figure 3:
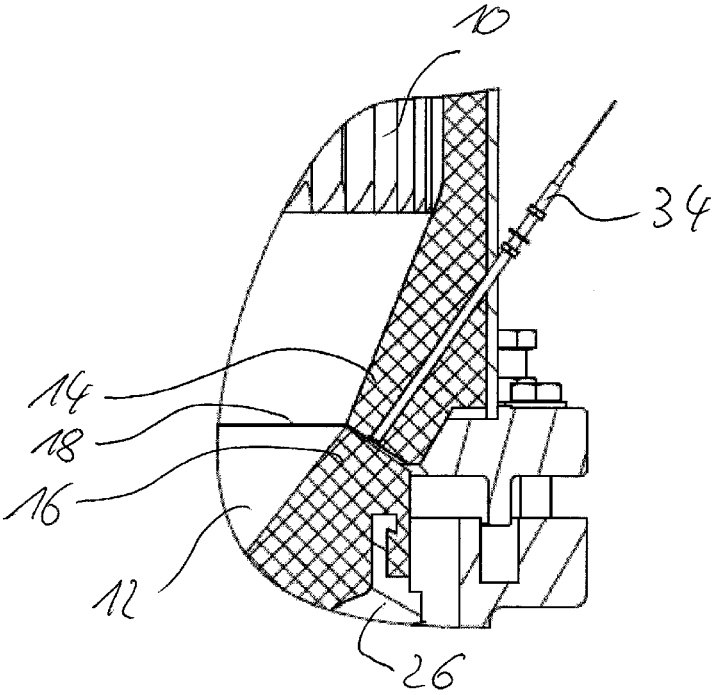

FIG. 3 a further enlarged part sectional view of the gap region.

The present invention will be described in the following with reference to a slide grinding machine in which the turntable is moved relative to the work container and the ring gap is acted on by compressed air from below, i.e. from outside the internal volume of the work container. The invention could, however, also generally be implemented in that the work container is moved or in that the ring gap is acted on by compressed air from above.

FIG. 1 shows in a part section a slide grinding machine having a work container 10 which is open at its upper side and which is closed by a turntable 12 at its lower side, with a peripheral ring gap 18 being present between the lower container margin 14 and the margin 16 of the turntable 12. The size of the ring gap 18 varies in dependence on the machine size and on the demands and can lie in the range from approximately 0.2 mm to approximately 0.8 mm. A respective ring gap with a gap width of zero is shown in FIG. 1 to FIG. 3.

The work container 10 is fixedly mounted on a machine frame (not shown), whereas the turntable 12 can be rotated about its center axis A with the aid of a motor (likewise not shown). For this purpose, the shaft 20 of the turntable 12 is rotatably supported in an axial bearing 22 mounted on the machine rack, with the shaft 20 being able to be moved with the aid of a dual action hydraulic cylinder 24 along the axis of rotation A in the direction of the work container 10 and away from it. In other words, with the aid of the actuating drive realized by the hydraulic cylinder 24, the turntable 12 can be moved relative to the work container 10 so that the turntable and the work container can be moved toward one another and away from one another in relation to one another.

A bearing part 26 is located beneath the turntable 12; it is fixedly connected to the machine frame and forms a closed space together with the turntable 12 through which closed space liquid can flow off with an open ring gap 18. The space 28 is connected to a liquid container 30 in which a transducer 32 is located which is used as a liquid level sensor in the operation of the slide grinding machine, but which is also able to measure the air pressure present in the space 28. The space 28 can be vented via a valve—not shown—but is closed in an air-tight manner with a closed ring gap and a closed valve. The space 28 can be acted on by compressed air via an air pressure connection (not recognizable in the drawing) so that the ring gap 18 is also acted on by compressed air. An air pressure thus arises in the interior of the space 28 with a closed ring gap 18 which can be measured with the aid of the transducer 32.

As FIGS. 1 and 3 further illustrate, a temperature sensor 34 is introduced in the work container 10 in the region of the ring gap 18 and its front end terminates substantially flush with the container wall or with the polyurethane coating of the work container 10 hatched in FIGS. 2 and 3 in the region of the ring gap 18. In this manner, the temperature present in the region of the ring gap 18, for example the temperature of a process liquid conducted through the ring gap can be measured very exactly and a conclusion can then indirectly be drawn from it on the gap size change which results by the temperature change.

To detect the stroke of the turntable 12, the actuating drive 24 is provided with a deflection sensor 36 which measures the stroke of the turntable 12 parallel to the axis of rotation A. In this manner, the axial spacing between the work container 10 and the turntable 12 can be measured very exactly and the gap width can thus also be set. The rotational drive of the turntable 12 takes place via a belt drive 38, with a drive via a chain or the like also being conceivable. The belt drive 38 is driven by the drive motor (not shown) and drives the turntable 12 via a belt pulley 40 which is fastened to the shaft 20. On an axial displacement of the shaft 20 with the aid of the hydraulic cylinder 24, the belt drive 38 compensates the axial stroke which occurs.

The method in accordance with the invention for the automatic gap setting with the aid of a regulation will be described in the following.

To determine a reference value for the gap width of zero, first the work container is emptied and any liquid located in the space 28 is removed or drained off. Subsequently, the space 28 is acted on with compressed air via the compressed air connection with an open gap so that the ring gap 18 is also acted on evenly with compressed air over its total periphery on its pressure side, i.e. in the region of the space 28. The supply pressure can here amount to 300 mbar, for example. Since the gap is still open, the compressed air first escapes in the region of the space 28 (shown hatched in FIG. 2) through the ring gap 18.

Subsequently, with otherwise closed venting valves, the gap width is increasingly reduced in size in that the hydraulic cylinder 24 is actuated. As the ring gap is increasingly closed, the air pressure within the space 28 increased, which can be detected by the sensor 32. If the air pressure measured by the sensor 32 on the pressure side of the gap 18, i.e. in the space 28, has reached a predefined limit value of, for example 150 mbar, the hydraulic cylinder 24 is stopped in its position and the position determined by the displacement sensor 36 is stored in the control and regulation device. A reproducible parameter for the zero frequency of the measurement and regulation system is hereby found so that, starting from this reference value, the desired gap width can be set in that the hydraulic cylinder 24 is actuated in the opposite direction so that the turntable 12 is lowered a little downwardly.

During the following slide grinding, the position of the turntable thus set in the axial direction can be permanently maintained in that the temperature sensor 34 measures the temperature present in the region of the gap 18 and adjusts the turntable 18 relative to the determined reference value (zero point) by a predefined value on a temperature increase or on a temperature reduction. It was determined in practical experiments in this respect that the gap dimension changes by a constant value on a temperature change of, for example, 1° C. This change of the gap dimension can be corrected continuously, automatically and permanently by a corresponding regulation in that the hydraulic cylinder 24 is correspondingly actuated by the control and regulation device. During operation, the measuring and regulating device continuously measures the temperature present in the gap and accordingly adjusts the gap dimension by actuating the actuating drive 24 on a temperature change. The gap dimension can hereby be kept constant with a precision of approximately 25 μm.

The determination of the reference value for the gap width of zero can be repeated with reference to predefined criteria, for example after reaching a defined operating time of the slide grinding machine or on an exceeding of a predefined temperature limit.

It must be mentioned in addition that in the region of the hydraulic supply of the hydraulic cylinder 24 (a pneumatic control or also a stepped motor could generally also be used as an actuating drive), a pressure regulation valve and an additional pressure sensor are present which are present as redundant monitoring devices in addition to the pressure sensor 32 if the latter should have a malfunction. In addition, the pressure sensor in the region of the hydraulics serves for the exact control of the stroke of the hydraulic cylinder 24.

The invention claimed is:

1. A method for the automatic gap setting in slide grinding machines having a turntable, wherein the gap width of a ring gap located between the turntable and a work container is set by a regulation, wherein the gap is acted on by compressed air;

air pressure proximate to the gap is measured on a pressure side;

the turntable and the work container are moved toward one another in relation to one another;

relative positions of the turntable and the work container are defined as a reference value for the gap width of zero which is present when the measured air pressure has reached a predefined limit value; and a constant gap width is set on the basis of the defined relative position for determining a gap width of zero.

2. The method in accordance with claim 1, wherein the constant gap width is set while taking account of only a temperature measured in the region of the gap.

3. The method in accordance with claim 2, wherein the constant gap width is set while taking account of only a temperature measured in the region of the gap without using a pressure measurement.

4. The method in accordance with claim 3, wherein the constant gap width is set while taking account of only a temperature measured in the region of the gap without using an air pressure measurement or a dynamic pressure measurement.

5. The method in accordance with claim 1, wherein the relative position is determined by a displacement sensor.

6. The method in accordance with claim 1, wherein a total periphery of the ring gap is acted on evenly by compressed air.

7. The method in accordance with claim 1, wherein a closed space beneath the ring gap is charged with compressed air.

8. The method in accordance with claim 1, wherein the turntable is moved by a hydraulic cylinder in a direction of the work container.

9. The method in accordance with claim 1, wherein the turntable is set into rotation by a belt drive.

10. The method in accordance with claim 1, wherein a new reference value is defined for the gap width of zero after a predefined operating time of the slide grinding machine and/or after a predefined temperature change has been reached in the region of the gap.

11. The method in accordance with claim 1, wherein a transducer, which is used as a liquid level sensor on an operation of the slide grinding machine, is used for measuring the air pressure.

12. The method in accordance with claim 1, wherein the turntable and the work container are no longer moved toward one another in relation to one another when the measured air pressure has reached a predefined maximum value.

13. The method in accordance with claim 12, wherein the predefined maximum value is equal to the predefined limit value.

* * * * *